US006343791B1

(12) United States Patent
Anyan et al.

(10) Patent No.: US 6,343,791 B1
(45) Date of Patent: Feb. 5, 2002

(54) SPLIT MESH END RING

(75) Inventors: Steven L. Anyan; Thomas E. Johnson, both of Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/375,195

(22) Filed: Aug. 16, 1999

(51) Int. Cl.[7] ..... E21B 33/128

(52) U.S. Cl. ..... 277/337; 277/339; 277/341; 277/342

(58) Field of Search ..... 277/323, 327, 277/342, 537, 538, 603, 341, 339; 166/116, 141, 195, 120

(56) References Cited

U.S. PATENT DOCUMENTS

| | | | | | |
|---|---|---|---|---|---|
| 609,752 | A | * | 8/1898 | Angell | |
| 1,826,967 | A | * | 10/1931 | Thomas | |
| 2,791,278 | A | * | 5/1957 | Clark, Jr. | 277/338 |
| 3,061,013 | A | * | 10/1962 | Thomas, Jr. | 277/342 |
| 3,171,492 | A | * | 3/1965 | Cochran | 277/342 |
| 3,215,205 | A | * | 11/1965 | Sizer | 166/120 |
| 3,464,709 | A | * | 9/1969 | Furgason et al. | 277/342 |
| 3,469,629 | A | * | 9/1969 | Adamache et al. | 166/182 |
| 4,328,974 | A | * | 5/1982 | White et al. | |
| 4,452,463 | A | | 6/1984 | Buckner | |
| RE31,933 | E | * | 7/1985 | Taylor et al. | 166/120 |
| 4,588,029 | A | * | 5/1986 | Blizzard | 166/120 |
| 4,611,658 | A | * | 9/1986 | Salerni et al. | 277/337 |
| 4,720,113 | A | | 1/1988 | Hertz, Jr. | |
| 4,730,835 | A | | 3/1988 | Wilcox et al. | |
| 4,753,444 | A | | 6/1988 | Jackson et al. | |
| 4,811,959 | A | * | 3/1989 | Bullard et al. | 277/342 |
| 5,103,904 | A | | 4/1992 | Luke et al. | |
| 5,165,703 | A | | 11/1992 | Morvant | |
| 5,388,648 | A | | 2/1995 | Jordan, Jr. | |
| 5,411,085 | A | | 5/1995 | Moore et al. | |
| 5,425,420 | A | | 6/1995 | Pringle | |
| 5,431,412 | A | | 7/1995 | Reinhardt et al. | |
| 5,676,384 | A | | 10/1997 | Culpepper | |
| 5,775,429 | A | | 7/1998 | Arizmendi et al. | |

* cited by examiner

*Primary Examiner*—Anthony Knight
*Assistant Examiner*—Alison K. Pickard
(74) *Attorney, Agent, or Firm*—Trop, Pruner & Hu P.C.

(57) ABSTRACT

The present invention generally provides a seal assembly, or seal array, having a seal body and one or more non-extrusion end rings to prevent or minimize extrusion of the seal body between either the packer assembly and the casing or between the packer assembly and the gauge ring used to energize the seal assembly. More particularly, the end ring of the present invention has discrete deformable portions, which may be integrally encapsulated within a resilient cover or which may be provided as separate end ring members. The discrete deformable portions may further be provided with a deformable hinge portion formed therebetween.

37 Claims, 6 Drawing Sheets

SPLIT MESH END RING

BACKGROUND OF THE INVENTION

1. Field of Invention

The present invention relates generally to sealing devices and, more particularly, to seals, packings and the like used in environments wherein at least a portion of the sealing device is subjected to extrusion forces. Typically, such forces are experienced by down hole oil tools. For example, in the application of a down hole packer, the area between the oil tool and the well casing is sealed.

2. Related Art

Sealing devices, such as seals or packings, whether of the dynamic or static type, are typically made of materials which, to some extent are resilient or at least deformable. In order to seal effectively, it may typically be necessary for the sealing device to be placed under some compressive loading between the components of the assembly to be sealed. Because of the compressive load and the deformable nature of at least a portion of the seal, if the seal is subjected to sufficient pressure and temperature, there may be a tendency for portions of the seal to be subjected to extrusion forces which may distort the seal and impair its effectiveness as a seal. In more severe cases, such forces may also force portions of the seal into clearances between the components to be sealed.

Previous solutions have been contemplated to prevent or minimize such extrusion problems. For example, FIG. 2 shows a prior seal assembly, or seal array, 200, including a seal body 110 and a pair of non-extrusion end rings 230. Traditional non-extrusion end rings 230 of this type are of one-piece design and are typically constructed of stainless steel wire mesh woven and compacted to provide for controlled deformation while preventing or minimizing extrusion within the annulus formed between the packer assembly 10 and the casing 30 desired to be sealed. A problem with this type of seal array arises as the portion of the non-extrusion end rings 230 proximate the packer assembly 10 may tend to lift outwardly away from the packer assembly 10 as compressive forces are applied to energize the seal body 110 as the portion of the non-extrusion end rings 230 proximate the casing 30 deform radially outward and away from the seal body to fill the annulus 40 therebetween. To minimize the portion of the end rings 230 proximate the mandrel, or body, 50 from lifting away from the packer mandrel 50, other prior seal arrays such as seal array 300 shown in FIG. 3 have provided a notch 330 integrated within the end ring 320. The notch 330 provides a pivot point to control the location of the pivot and to minimize lifting of the end ring 320 from the packer mandrel 50. Such an arrangement has not proven to be sufficient to prevent or adequately minimize extrusion by the seal body 110, particularly between the end ring 320 and the packer mandrel 50. Other prior seal arrays have provided complex arrangements of wedges or other configurations, which also have proven impractical or insufficient.

Accordingly, there is a need for a packer assembly and, more particularly, a seal assembly having a simple, inexpensive, non-extrusion end ring that will minimize lifting of the end ring from the packer mandrel and minimize or prevent extrusion of the seal body within the annulus provided between the packer assembly and the casing, between the element and the mandrel, and between the end ring itself and the packer assembly.

SUMMARY

In one aspect, the present invention is directed to a non-extrusion end ring for use with a packer seal array to seal against the inside wall of a well casing and against a packer mandrel, wherein the non-extrusion ring includes at least first and second discrete deformable portions. A feature of this aspect of the invention is that the first discrete deformable portion may be an axial sealing portion for preventing extrusion of a resilient seal body between a packer mandrel and a packer gauge ring, and the second discrete deformable portion may be a radial sealing portion for preventing extrusion of the resilient seal body between the gauge ring and the inside wall of the casing. Another feature is that the axial sealing portion may be adapted to move generally axially along the packer mandrel. The radial sealing portion may also be adapted to move generally radially away from the packer mandrel and generally outwardly away from the seal body to seal an annulus between the packer gauge ring and the inside wall of the well casing. Yet another feature is that the non-extrusion end ring may further include a resilient, deformable, hinge portion disposed between the axial and radial sealing portions.

Still another feature is that the resilient, deformable, hinge portion may be fixedly connected to or integral with the seal body, and the resilient, deformable, hinge portion may be fixedly connected to the axial and radial sealing portions of the non-extrusion end ring. Further, the axial sealing portion may be disposed between the packer mandrel and the radial sealing portion, and the non-extrusion end ring may include a retaining ring associated therewith and located proximate the packer mandrel and the axial sealing portion of the non-extrusion end ring. Still further, the axial and radial sealing portions may each comprise wire mesh, and the wire mesh of the axial sealing portion may be encapsulated within a resilient coating. The resilient coating of the axial sealing portion may be rubber, and the wire mesh of the radial sealing portion may be encapsulated within a resilient coating. Further, the resilient coating of the radial sealing portion may also be rubber. As an alternative to providing a resilient coating, the wire mesh may be impregnated with a resilient material.

Yet another feature of this aspect of the invention is that the wire mesh of both the axial and radial sealing portions may each be separately encapsulated within a resilient coating, and the resilient coating may be rubber. Further, the wire mesh of both the axial and radial sealing portions may be encapsulated together within a resilient coating, and the resilient coating may be rubber.

In another aspect, the present invention is directed to a seal array for use with a packer having a packer mandrel and first and second gauge rings for compressing and energizing the seal array to seal against the inside wall of a well casing and against the packer mandrel, comprising: a resilient seal body; at least a first and second non-extrusion end ring disposed proximate opposing ends of the seal body between the seal body and the first and second gauge rings, respectively; and each of the non-extrusion rings including at least first and second discrete deformable portions.

A feature of this aspect of the present invention is that the first discrete deformable portion may be an axial sealing portion for preventing extrusion of the seal body between the packer mandrel and a packer gauge ring, and wherein the second discrete deformable portion is a radial sealing portion for preventing extrusion of the resilient seal body between the gauge ring and the inside wall of the casing. The axial sealing portion may be adapted to move generally axially along the packer mandrel, and the radial sealing portion may be adapted to move generally radially away from the packer mandrel and generally outwardly away from the seal body to seal an annulus between a packer gauge ring and the inside wall of the well casing. The seal array may further include a resilient, deformable, hinge portion disposed between the axial and radial sealing portions, and the resilient, deformable, hinge portion is fixedly connected to or integral with the seal body. The resilient, deformable, hinge portion may be fixedly connected to the axial and radial sealing portions of the non-extrusion end ring, and the axial sealing portion may be disposed between the packer mandrel and the radial sealing portion.

Another feature of this aspect of the invention is that the seal body may include a retaining ring associated therewith and located proximate the packer mandrel and the axial sealing portion of the non-extrusion end ring. Further, the axial and radial sealing portions may each comprise wire mesh, and the wire mesh of the axial sealing portion may be encapsulated within a resilient coating. The resilient coating of the axial sealing portion may be rubber, and the wire mesh of the radial sealing portion may be encapsulated within a resilient coating. The resilient coating of the radial sealing portion may be rubber, and the wire mesh of both the axial and radial sealing portions may each be separately encapsulated within a resilient coating, which may be rubber. Further, the wire mesh of both the axial and radial sealing portions may be encapsulated together within a resilient coating, and the resilient coating may be rubber.

In still another aspect, the invention may be directed to a packer assembly to seal against the inside wall of a well casing, comprising: a packer mandrel; a seal array disposed around the packer mandrel, including: a resilient seal body; at least a first and second non-extrusion end ring disposed proximate opposing ends of the seal body; each of the non-extrusion rings including at least first and second discrete deformable portions; and first and second gauge rings disposed around the packer mandrel on opposing ends of the seal array for compressing and energizing the seal array to seal against the inside wall of a well casing and against the packer mandrel. A feature of this aspect of the invention is that the first discrete deformable portion may be an axial sealing portion for preventing extrusion of the seal body between the packer mandrel and a packer gauge ring, and the second discrete deformable portion may be a radial sealing portion for preventing extrusion of the resilient seal body between the gauge ring and the inside wall of the casing.

Another feature of this aspect of the invention is that the axial sealing portion may be adapted to move generally axially along the packer mandrel, and the radial sealing portion may be adapted to move generally radially away from the packer mandrel and generally outwardly away from the seal body to seal an annulus between a packer gauge ring and the inside wall of the well casing. The packer assembly may further include a resilient, deformable, hinge portion disposed between the axial and radial sealing portions, and the resilient, deformable, hinge portion may be fixedly connected to or integral with the seal body, wherein the resilient, deformable, hinge portion may be fixedly connected to the axial and radial sealing portions of the non-extrusion end ring. The axial sealing portion may be disposed between the packer mandrel and the radial sealing portion.

Still another feature of this aspect of the invention is that the seal body may include a retaining ring associated therewith and located proximate the packer mandrel and the axial sealing portion of the non-extrusion end ring. Further, the axial and radial sealing portions may each comprise wire mesh, and the wire mesh of the axial sealing portion may be encapsulated within a resilient coating, wherein the resilient coating of the axial sealing portion may be rubber. Further, the wire mesh of the radial sealing portion may be encapsulated within a resilient coating, which may be rubber. Still further, the wire mesh of both the axial and radial sealing portions may each be separately encapsulated within a resilient coating, which may be rubber. Still further, the wire mesh of both the axial and radial sealing portions may be encapsulated together within a resilient coating, and the resilient coating may be rubber.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a seal assembly, or seal array, having a seal body and one or more non-extrusion end rings to prevent or minimize extrusion of the seal body between either the packer assembly and the casing or between the packer assembly and the gauge ring used to energize the seal assembly. More particularly, the end ring of the present invention has discrete deformable portions, which may be integrally encapsulated within a resilient cover or which may be provided as separate end ring members. The discrete deformable portions may further be provided with a deformable hinge portion formed therebetween.

First Embodiment

Figure 1:
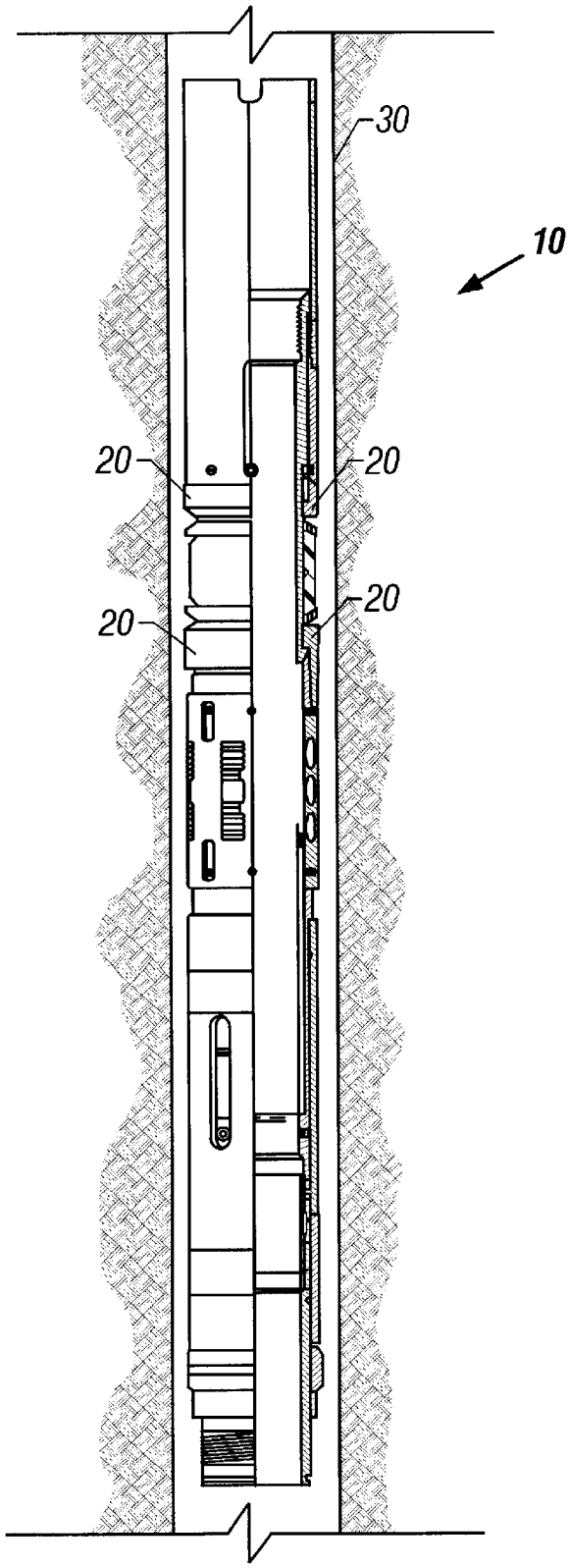
FIG. 1 is a combined elevational and cross-sectional view of a packer within a section of casing incorporating a sealing assembly in accordance with the present invention.
Figure 2:
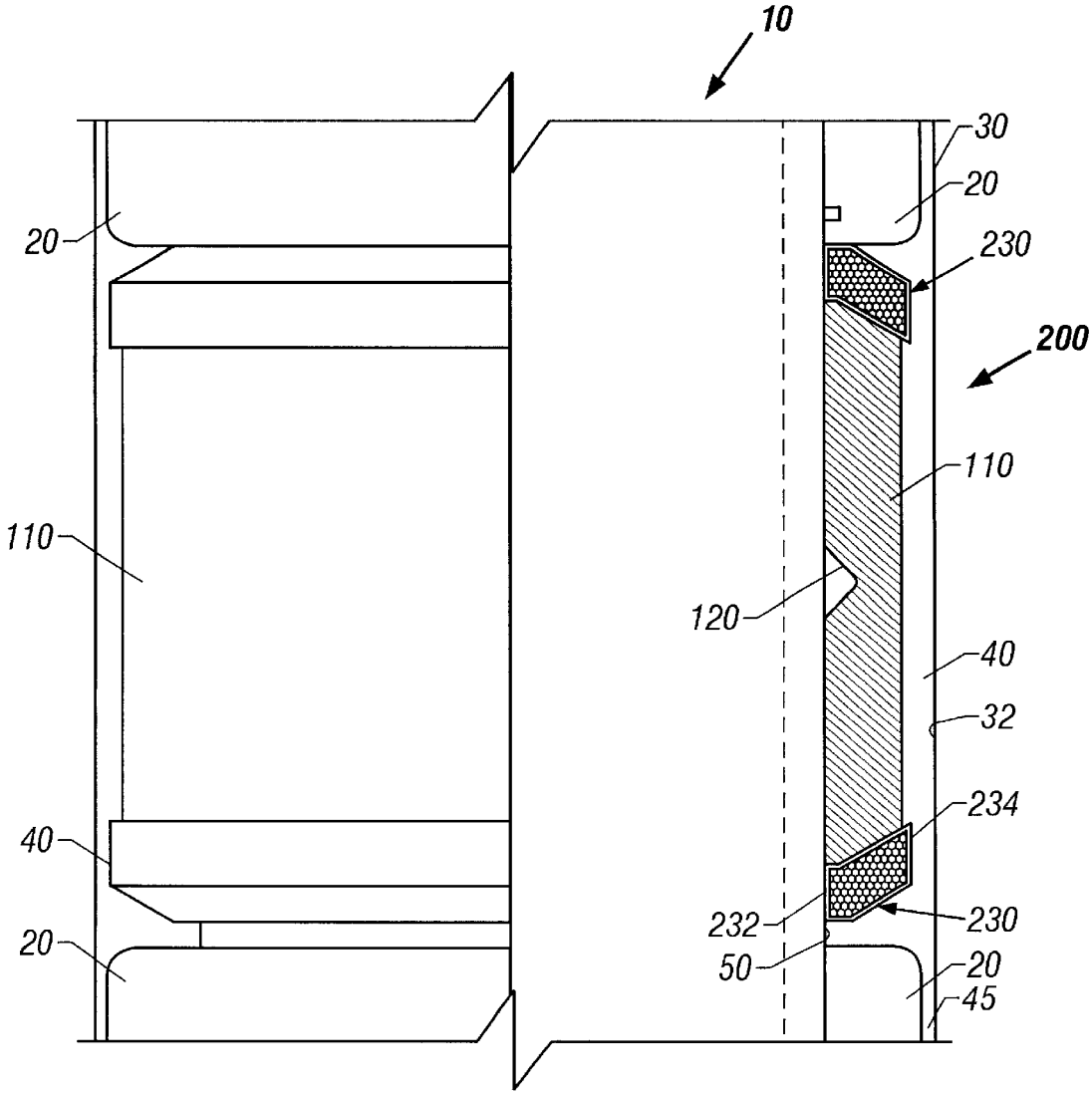
FIG. 2 (Prior Art)
FIG. 2 is a partial view, partly in cross-section, of a first prior non-extrusion end ring, shown in connection with a conventional seal body.
Figure 3:
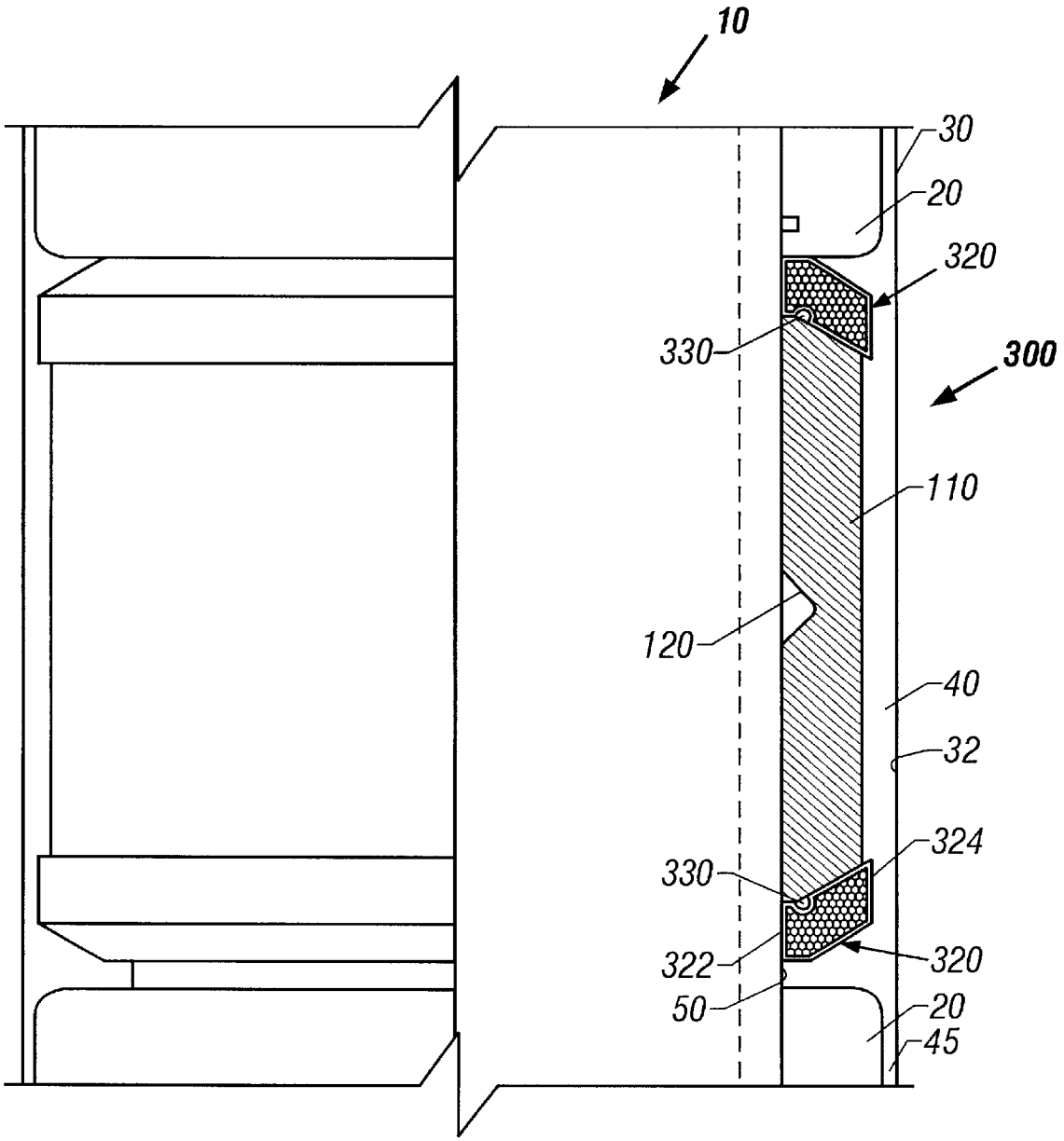
FIG. 3 (Prior Art)
FIG. 3 is a partial view, partly in cross-section, of a second prior non-extrusion end ring, shown in connection with a conventional seal body.
Figure 4:
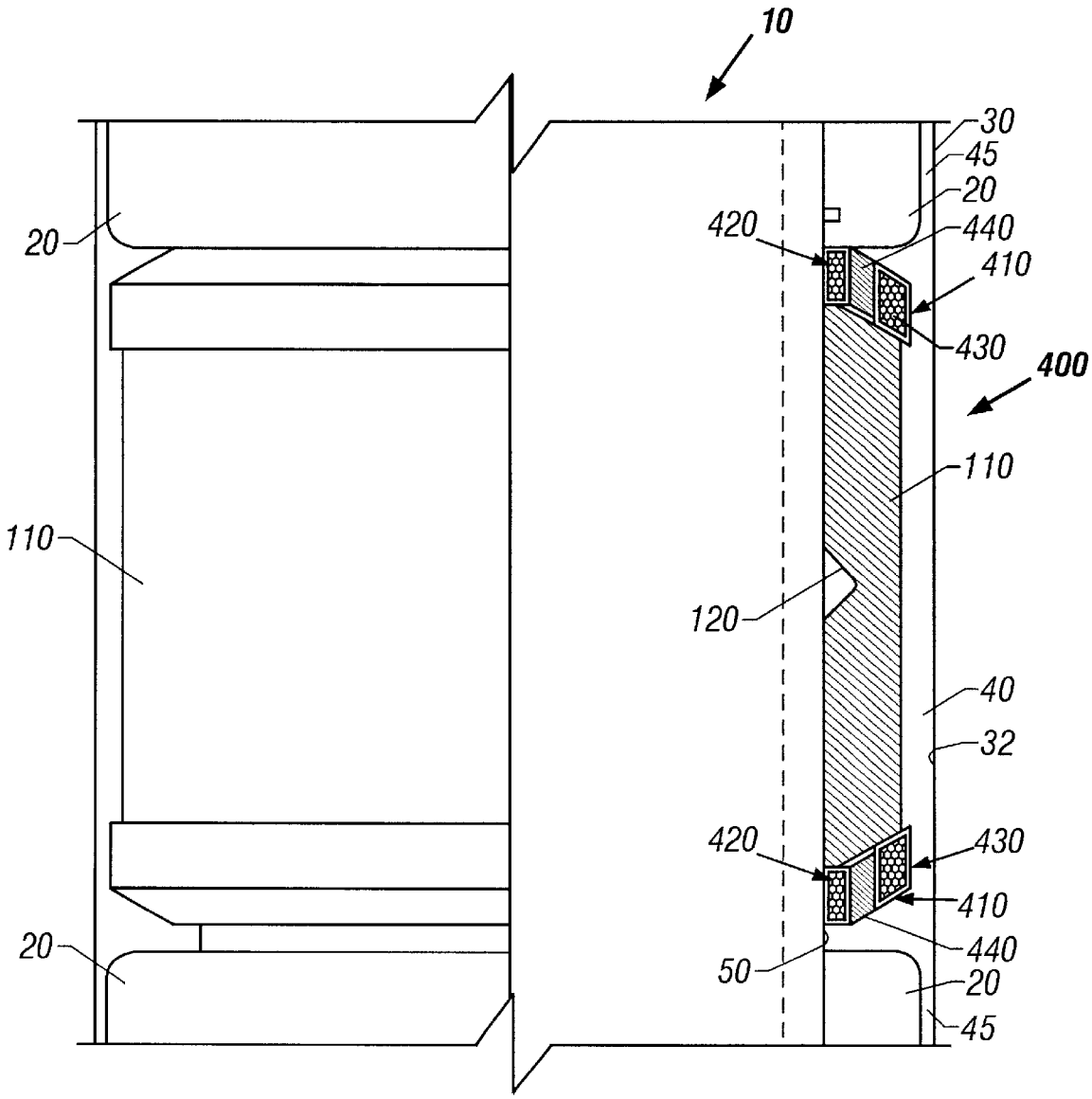
FIG. 4 is a partial view, partly in cross-section, of a first embodiment of a non-extrusion end ring of the present invention shown in connection with a conventional seal body.

FIG. 4 illustrates a seal assembly 400 according to a first embodiment of the present invention, shown disposed around a packer mandrel 50 and between two packer gauge rings 20 of a packer assembly 10. Packer assembly 10 is shown disposed within a section of well casing 30 within a production well. Seal assembly, or seal array, 400 includes a seal body 110 disposed around packer mandrel 50 between the packer mandrel 50 and an inside surface 32 of casing 30. An annular space 40 is provided initially between seal body 110 and the inside surface 32 of casing 30 to enable the unset packer to be inserted in the wellbore during running operations of the packer assembly 10. It is this annular space 40 within which the seal body 110 is designed to be expanded to seal a desired downhole section within the casing 30. Seal body 110 includes a v-shaped notch 120 to facilitate proper expansion of the seal body 110 within the casing 30 to seal against the inside surface 32 of the casing 30. Packer assembly 10 includes a pair of gauge rings 20 disposed on opposing sides of the seal body 110, at least one of which is adapted to slide along packer mandrel 50 in a direction towards seal body 110 to engage and energize seal body 110. Gauge rings 20 may typically have an outer diameter approximating the drift diameter of the packer assembly 10. An annular space is, therefore, generally provided between the gauge rings 20 and the inside surface 32 of the casing 30 to facilitate running of the packer assembly 10 within casing 30.

Seal assembly 400 further includes non-extrusion end rings 410 disposed around the packer mandrel 50 and between the seal body 110 and the gauge rings 20 to prevent or minimize extrusion of the seal body between the mandrel 50 and the gauge rings 20 and between the gauge rings 20 and the inside surface 32 of the casing 30. In the first embodiment, the non-extrusion rings 410 comprise a first deformable portion 420 and a second deformable portion 430. The first and second deformable portions 420, 430 are preferably discrete sealing portions, each of which are preferably a discrete interlocking wire mesh unit.

In the context of the present invention, discrete sealing portions may include sealing portions 420, 430 in which the wire mesh in one sealing portion does not interlock between the two sealing portions. It should be noted that the discrete sealing portions 420, 430 may be joined and/or encapsulated by a common resilient member, as described further hereinafter, or may otherwise be connected to one another. However, the wire mesh units comprising the discrete sealing portions 420, 430 do not interlock in the preferred embodiment or otherwise engage with one another. As a result, one of the sealing portions 420, 430 is permitted to pivot, or flare, and move generally radially away from the mandrel 50 and generally outwardly away from the seal body 110 while the other of the sealing portions 420, 430 is permitted to move generally axially along the mandrel 50 between the seal body 110 and the gauge ring 20 without being lifted away from the mandrel 50 by the movement of the other sealing portion 420, 430 because they are not connected.

Preferably, the first sealing portion 420 is an axial sealing portion, which is adapted to move generally axially along the mandrel 50 without lifting away from the mandrel 50 as the gauge ring 20 compresses the non-extrusion end ring 410 against the seal body 110 to engage the seal body 110. The second sealing portion 430 is preferably a radial sealing portion 430.

The radial sealing portion 430 is adapted to flare and move generally radially away from the mandrel 50 and generally outward away from the seal body 110 as the seal body 110 is engaged outward by the compressive force from the gauge ring 20. The radial and outward movement of radial seal portion 430 as seal body 110 expands to fill the annular space 40 causes radial seal portion 430 to fill the annular space 40 between the seal body 110 and the gauge ring 20 thus preventing or minimizing extrusion of the resilient seal body 110 within the annular space 45 between the gauge ring 20 and the inside surface 32 of the casing 30.

The axial sealing portion 420 is adapted to move axially along the mandrel 50 as the gauge ring 20 moves generally toward and compresses the seal body 110. The axial movement of axial sealing portion 420 without induced rotation from radial sealing portion 430 as gauge ring 20 compresses the seal body 110 allows the axial sealing portion 420 to maintain full contact of its inside surface against the mandrel 50. By preventing or minimizing lifting of the axial sealing portion 420 from the surface of the mandrel 50, seal body 110 is minimized or prevented from extruding between the axial sealing portion 420 and the mandrel 50, which prevents or minimizes extrusion of the seal body 110 between the gauge ring 20 and mandrel 50.

In the first embodiment, non-extrusion end ring 410 further includes a resilient, non-mesh, hinge portion 440. Hinge portion 440 is disposed between the axial and radial sealing portions 420, 430, and is preferably constructed of HNBR rubber, but could be constructed of any resilient, deformable material having the desired characteristics. Preferably, the material is suitably sized and selected with sufficient resilience to allow movement of the radial sealing portion 430 without translating the movement of the radial sealing portion 430 to the axial sealing portion 420, which could otherwise lift the axial sealing portion 420 from the surface of the mandrel 50. The interlocking mesh material selected for the radial and axial sealing portions 430, 420 is conventional, and may preferably be a woven and compacted mesh of interlocking stainless steel wire. However, it should be noted that other suitable materials may be selected having the desirable characteristics. It should also be noted that the hinge portion 440 may be a separate ring of resilient material, the hinge portion 440 may be bonded to or otherwise attached to sealing portions 420, 430, or it may be encapsulated along with sealing portions 420, 430 within a coating of rubber or other suitable material to provide a composite unit of 3 discrete elements. Also note that, in an alternative embodiment, the resilient material is impregnated into the base material, or elements (as opposed to coating the base materials or elements), to form the composite unit.

Second Embodiment

Figure 5:
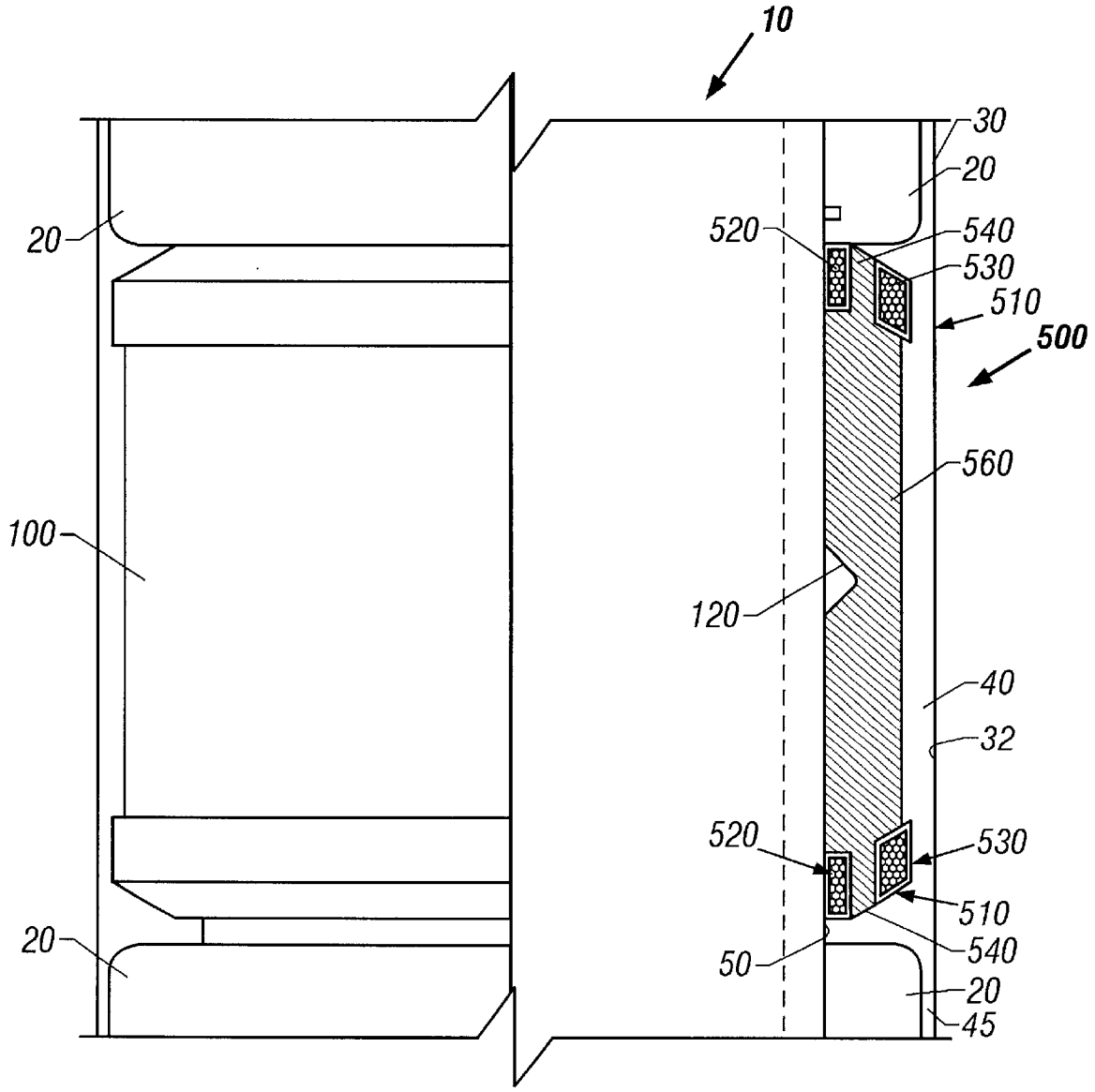
FIG. 5 is a partial view, partly in cross-section, of a second embodiment of a non-extrusion end ring of the present invention shown in connection with an improved seal body in accordance with the second embodiment of the present invention.

FIG. 5 illustrates a seal assembly 500 according to a second embodiment of the present invention, shown disposed around a packer mandrel 50 and between two packer gauge rings 20 of a packer assembly 10. Packer assembly 10 is shown disposed within a section of well casing 30 within a production well. Seal assembly, or seal array, 500 includes an improved seal body 560 disposed around packer mandrel 50 between the packer mandrel 50 and an inside surface 32 of casing 30. An annular space 40 is provided initially between seal body 560 and the inside surface 32 of casing 30 to enable the unset packer to be inserted in the wellbore during running operations of the packer assembly 10. It is this annular space 40 within which the seal body 560 is designed to be expanded to seal a desired downhole section within the casing 30. Seal body 560 includes a v-shaped notch 120 to facilitate proper expansion of the seal body 560 within the casing 30 to seal against the inside surface 32 of the casing 30. Packer assembly 10 includes a pair of gauge rings 20 disposed on opposing sides of the seal body 560, which are adapted to slide along packer mandrel 50 in a direction towards seal body 560 to engage and energize seal body 560. Gauge rings 20 may typically have an outer diameter approximating the drift diameter of the packer assembly 10 to centralize the assembly. An annular space is, therefore, generally provided between the gauge rings 20 and the inside surface 32 of the casing 30 to facilitate running of the packer assembly 10 within casing 30.

Seal assembly 500 further includes non-extrusion end rings 510 disposed around the packer mandrel 50 and between the seal body 560 and the gauge rings 20 to prevent or minimize extrusion of the seal body 560 between the mandrel 50 and the gauge rings 20 and between the gauge rings 20 and the inside surface 32 of the casing 30. In the second embodiment, the non-extrusion rings 510 comprise a first deformable portion 520 and a second deformable portion 530. The first and second deformable portions 520, 530 are preferably discrete sealing portions, each of which are preferably a discrete interlocking wire mesh unit. In the context of the present invention, discrete sealing portions may include sealing portions 520, 530 in which the wire mesh in one sealing portion does not interlock between the two sealing portions. The wire mesh units comprising the discrete sealing portions 520, 530 do not interlock or otherwise engage with one another. As a result, one of the sealing portions 520, 530 is permitted to flare and move generally radially away from the mandrel 50 and generally outwardly away from the seal body 560 while the other of the sealing portions 520, 530 is permitted to move generally axially along the mandrel 50 between the seal body 560 and the gauge ring 20 without being lifted away from the mandrel 50 by the radial and outward movement of the other sealing portion 520, 530.

Preferably, the first sealing portion 520 is an axial sealing portion 520, which is adapted to move generally axially along the mandrel 50 without lifting away from the mandrel 50 as the gauge ring 20 compresses the non-extrusion end ring 510 against the seal body 560 to engage the seal body 560. The second sealing portion 530 is preferably a radial sealing portion 530.

The radial sealing portion 530 is adapted to flare and move generally radially away from the mandrel 50 and generally outward away from the seal body 560 as the seal body 560 is engaged outward by the compressive force from the gauge ring 20. The radial and outward movement of radial seal portion 530 as seal body 560 expands to fill the annular space 40 causes radial seal portion 530 to fill the annular space 40 between the seal body 560 and the gauge ring 20 thus preventing or minimizing extrusion of the resilient seal body 560 within the annular space 45 between the gauge ring 20 and the inside surface 32 of the casing 30.

The axial sealing portion 520 is adapted to move axially along the mandrel 50 as the gauge ring 20 moves generally toward and compresses the seal body 560. The axial movement of axial sealing portion 520 without induced rotation from radial sealing portion 530 as gauge ring 20 compresses the seal body 560 allows the axial sealing portion 520 to maintain full contact of its inside surface against the mandrel 50. By preventing or minimizing lifting of the axial sealing portion 420 from the surface of the mandrel 50, seal body 560 is minimized or prevented from extruding between the axial sealing portion 520 and the mandrel 50, which prevents or minimizes extrusion of the seal body 560 between the gauge ring 20 and mandrel 50.

In the second embodiment, the improved seal body 560 includes a resilient, non-mesh, hinge, or flange, portion 540. Hinge portion 540 is integral with or otherwise connected to the seal body 560 and is adapted to be received by and/or otherwise disposed between the axial and radial sealing portions 520, 530. The seal body 560 and flange portion, or hinge portion 540 thereof is preferably constructed of HNBR rubber, but could be constructed of any resilient, deformable material having the desired characteristics. Preferably, the material is suitably sized and selected with sufficient resilience to allow flaring of the radial sealing portion 530 without translating the movement of the radial sealing portion 530 to the axial sealing portion 520, which could otherwise lift the axial sealing portion 520 from the surface of the mandrel 50. The interlocking mesh material selected for the radial and axial sealing portions 530, 520 is conventional, and may preferably be a woven and compacted mesh of interlocking stainless steel wire. However, it should be noted that other suitable materials may be selected having the desirable characteristics.

Third Embodiment

Figure 6:
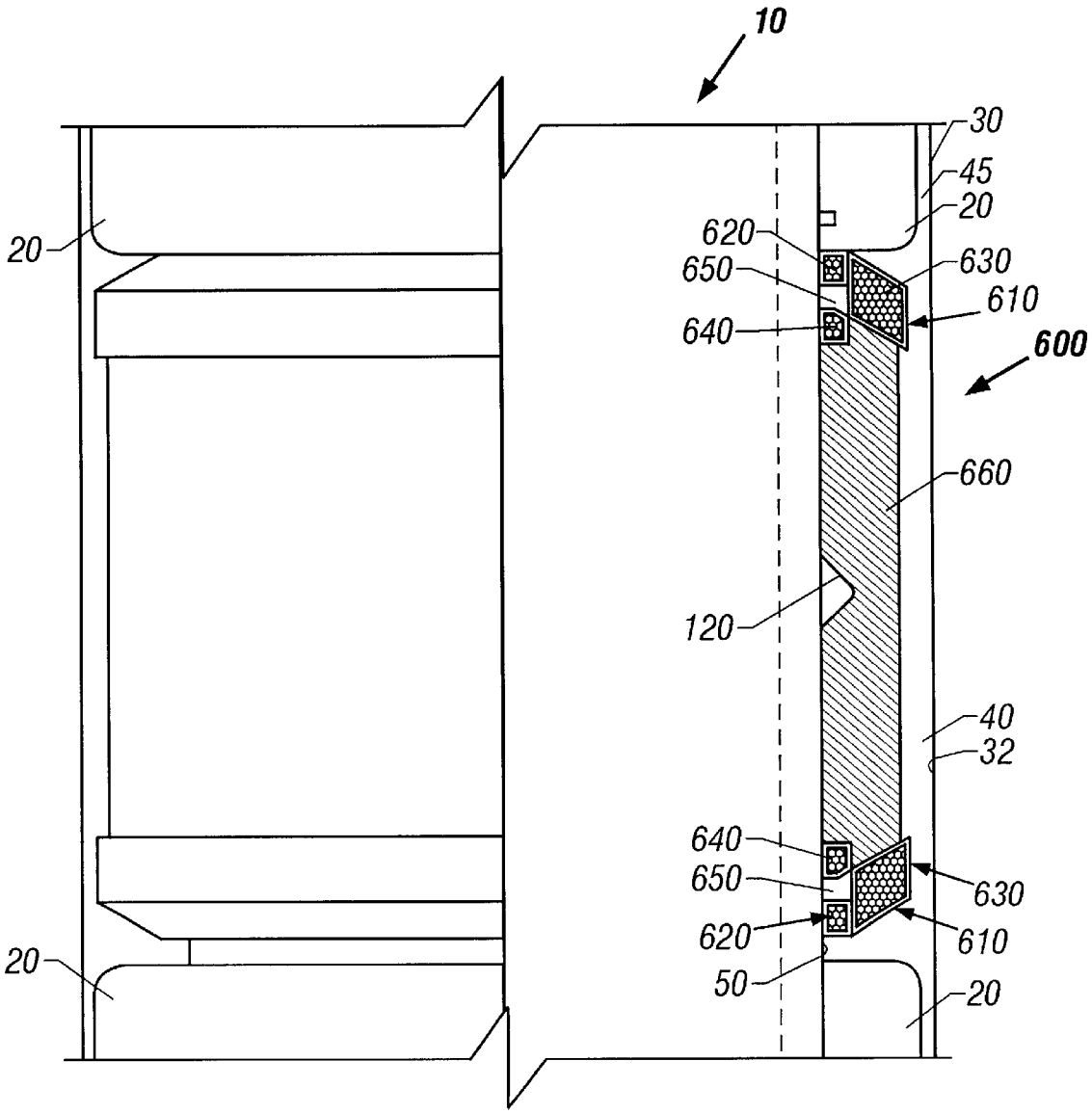
FIG. 6 is a partial view, partly in cross-section, of a third embodiment of a non-extrusion end ring of the present invention shown in connection with an improved seal body in accordance with the third embodiment of the present invention.

FIG. 6 illustrates a seal assembly 600 according to a third embodiment of the present invention, shown disposed around a packer mandrel 50 and between two packer gauge rings 20 of a packer assembly 10. The packer assembly 10 is shown disposed within a section of well casing 30 within a production well. Seal assembly, or seal array, 600 includes an improved seal body 660 disposed around packer mandrel 50 between the packer mandrel 50 and an inside surface 32 of casing 30. An annular space 40 is provided initially between seal body 660 and the inside surface 32 of casing 30 to enable the unset packer to be inserted in the wellbore during running operations of the packer assembly 10. It is this annular space 40 within which the seal body 660 is designed to be expanded to seal a desired downhole section within the casing 30. Seal body 660 includes a v-shaped notch 120 to facilitate proper expansion of the seal body 660 within the casing 30 to seal against the inside surface 32 of the casing 30. Packer assembly 10 includes a pair of gauge rings 20 disposed on opposing sides of the seal body 660, which are adapted to slide along packer mandrel 50 in a direction towards seal body 660 to engage and energize seal body 660. Gauge rings 20 may typically have an outer diameter approximating the drift diameter of the packer assembly 10. An annular space is, therefore, generally provided between the gauge rings 20 and the inside surface 32 of the casing 30 to facilitate running of the packer assembly 10 within casing 30.

Seal assembly 600 further includes non-extrusion end rings 610 disposed around the packer mandrel 50 and between the seal body 660 and the gauge rings 20 to prevent or minimize extrusion of the seal body 660 between the mandrel 50 and the gauge rings 20 and between the gauge rings 20 and the inside surface 32 of the casing 30. In the first embodiment, the non-extrusion rings 610 comprise a first deformable portion 620 and a second deformable portion 630. The first and second deformable portions 620, 630 are preferably discrete sealing portions, each of which are preferably a discrete interlocking wire mesh unit. In the context of the present invention, discrete sealing portions may include sealing portions 620, 630 in which the wire mesh does not interlock between the two sealing portions. It should be noted that the discrete sealing portions 620, 630 may be encapsulated within a common rubber coating (or impregnated with) to form a single unit of two discrete elements, or may otherwise be connected to one another. However, the wire mesh units comprising the discrete sealing portions 620, 630 do not interlock or otherwise engage with one another. As a result, one of the sealing portions 620, 630 is permitted to flare and move generally radially away from the mandrel 50 and generally outwardly away from the seal body 660 while the other of the sealing portions 620, 630 is permitted to move generally axially along the mandrel 50 between the seal body 660 and the gauge ring 20 without being lifted away from the mandrel 50 by the radial and outward movement of the other sealing portion 620, 630.

Preferably, the first sealing portion 620 is an axial sealing portion 620, which is adapted to move generally axially along the mandrel 50 without lifting away from the mandrel 50 as the gauge ring 20 compresses the non-extrusion end ring 610 against the seal body 660 to engage the seal body 660. The second sealing portion 630 is preferably a radial sealing portion 630.

The radial sealing portion 630 is adapted to flare and move generally radially away from the mandrel 50 and generally outward away from the seal body 660 as the seal body 660 is engaged outward by the compressive force from the gauge ring 20. The radial and outward movement of radial seal portion 630 as seal body 660 expands to fill the annular space 40 causes radial seal portion 630 to fill the seal the annular space 40 between the seal body 660 and the gauge ring 20 thus preventing or minimizing extrusion of the resilient seal body 660 within the annular space 45 between the gauge ring 20 and the inside surface 32 of the casing 30.

The axial sealing portion 620 is adapted to move axially along the mandrel 50 as the gauge ring 20 moves generally toward and compresses the seal body 660. The axial movement of axial sealing portion 620 without induced rotation from radial sealing portion 630 as gauge ring 20 compresses the seal body 660 allows the axial sealing portion 620 to maintain full contact of its inside surface against the mandrel 50. By preventing or minimizing lifting of the axial sealing portion 620 from the surface of the mandrel 50, seal body 660 is minimized or prevented from extruding between the axial sealing portion 620 and the mandrel 50, which prevents or minimizes extrusion of the seal body 660 between the gauge ring 20 and mandrel 50.

In the third embodiment, improved seal body 660 includes a pair of retaining rings 640 on opposing ends of seal body 660, each of which may comprise a non-mesh deformable ring similar in materials to that of seal portions 620, 630, it may be a brass or bronze, or it may be constructed of any other suitable materials having the desired characteristics. Retaining ring 640 may be either integrally molded within seal body 660, or it may be separately inserted into grooves provided along opposing ends of seal body 660 along its inside diameter proximate mandrel 50. In the third embodiment shown, the retaining ring 640 is preferably sized having essentially the same diameter of axial sealing portion 620 and is designed to abut axial sealing portion 620 upon compression and energizing of the seal body 660 by gauge ring 20. The use of retaining ring 640 may assist in preventing or minimizing extrusion of seal body 660 between the axial sealing portion 620 and the mandrel 50. Thus, the combination of the axial sealing portion 620 and the retainer ring 640 provides a double back-up system preventing extrusion. Preferably, the dimensions of sealing portions 620, 630 are selected such that an annular gap 650 is provided initially between axial sealing portion 620 and retaining ring 640 when sealing portion 630 is initially engaged with seal body 660. Accordingly, engagement and activation of the seal assembly 600 by gauge ring 20 will initially flare and expand sealing portion 630 before engagement between axial sealing portion 620 and seal body 660. It should be noted that a conventional seal body 110, having no retaining ring may also be used in connection with the third embodiment of the non-extrusion end rings 610.

Referring now to FIGS. 4 and 6, the improved seal body 660 shown in FIG. 6 may also be utilized in connection with the first embodiment of the non-extrusion end rings 410 shown in FIG. 4 and described in detail hereinabove. In such an embodiment (not shown), the axial sealing portion 420 would preferably be sized having a smaller outside diameter than that of retaining ring 640 of the improved seal body 660. However, other configurations are contemplated having, for example, the same outside diameters between the axial sealing portion 420 and the retaining ring 640.

Referring again to the third embodiment shown in FIG. 6, the interlocking mesh material selected for the axial and radial sealing portions 620, 630 is conventional, and may preferably be a woven and compacted mesh of interlocking stainless steel wire. However, it should be noted that other suitable materials may be selected having the desirable characteristics.

Accordingly, while the foregoing is directed to preferred embodiments of the present invention, other and further embodiments of the invention may be devised without departing from the basic scope thereof. For example, any number of end rings may be utilized in connection with a particular seal assembly. Further, conventional or other seal bodies may be utilized in connection with any of the embodiments described herein. The scope of the invention is determined by the claims which follow. It is the express intention of the applicant not to invoke 35 U.S.C. § 112, paragraph 6 for any limitations of any of the claims herein, except for those in which the claim expressly uses the word "means" together with an associated function.

We claim:

1. An end ring for use with a packer seal array that seals against the inside wall of a well casing and against a packer body, the end ring comprising:

at least first and second discrete deformable portions, wherein the first discrete deformable portion is an axial sealing portion abutting a seal body, and the second discrete deformable portion is a radial sealing portion abutting the seal body and positioned radially outside the first discrete deformable portion; and a resilient, deformable, hinge portion disposed between the axial and radial sealing portions.

2. The end ring of claim 1, wherein the axial sealing portion is adapted to move generally axially along the packer body.

3. The end ring of claim 2, wherein the radial sealing portion is adapted to move generally radially away from the packer body and generally outwardly away from the seal body to seal an annulus between a packer gauge ring and the inside wall of the well casing.

4. The end ring of claim 1, wherein the resilient, deformable, hinge portion is fixedly connected to or integral with the seal body.

5. The end ring of claim 1, wherein the resilient, deformable, hinge portion is fixedly connected to the axial and radial sealing portions of the end ring.

6. The end ring of claim 1, wherein the axial and radial sealing portions each comprise wire mesh.

7. The end ring of claim 6, wherein the wire mesh of the axial sealing portion is encapsulated within a resilient coating.

8. The end ring of claim 6, wherein the wire mesh of the radial sealing portion is encapsulated within a resilient coating.

9. The end ring of claim 6, wherein the wire mesh of both the axial and radial sealing portions are each separately encapsulated within a resilient coating.

10. The end ring of claim 6, wherein the wire mesh of both the axial and radial sealing portions are encapsulated together within a resilient coating.

11. The end ring of claim 6, wherein the wire mesh of the axial sealing portion is impregnated within a resilient material.

12. The end ring of claim 6, wherein the wire mesh of the radial sealing portion is impregnated within a resilient material.

13. A packer seal for sealing between a packer body and a wall of a well conduit, the packer seal comprising:

a seal element having opposing ends;

a first axial sealing portion and a second axial sealing portion for abutting the packer body and positioned proximal opposing sides of the seal element;

a first radial sealing portion and a second radial sealing portion abutting opposing sides of the seal element;

the first and second radial sealing portions positioned radially outside the first and second axial sealing portions respectively; and a first and second retainer ring abutting opposing sides of the seal element.

14. A seal array for use with a packer having a packer mandrel and first and second gauge rings for compressing and energizing the seal array to seal against the inside wall of a well casing and against the packer mandrel, the seal array comprising:

a resilient seal body;

at least a first and second end ring disposed proximate opposing ends of the seal body; and each of the rings including at least first and second discrete deformable portions, wherein the first discrete deformable portion is an axial sealing portion abutting the seal body; and the second discrete deformable portion is a radial sealing portion abutting the seal body and positioned radially outside the first discrete deformable portion, wherein the axial sealing portion is adapted to move generally axially along the packer mandrel, wherein the radial sealing portion is adapted to move generally radially outwardly from the packer mandrel, wherein the radial sealing portion is positioned radially outside the axial sealing portion, wherein each ring further comprises a hinge portion between the axial sealing portion and the radial sealing portion to enable the radial sealing portion to move generally radially outwardly without radially lifting the axial sealing portion.

15. The seal array of claim 14, wherein the hinge portion is attached to the axial and radial sealing portions.

16. The seal array of claim 15, wherein the hinge portion is formed of a resilient, deformable material to allow radial movement of the radial sealing portion without radially lifting the axial sealing portion.

17. The seal array of claim 14, wherein each ring further comprises a coating encapsulating the axial sealing portion, radial sealing portion, and hinge portion.

18. The seal array of claim 14, wherein the hinge portion is attached to the seal body.

19. The seal array of claim 14, wherein the hinge portion is integral with the seal body.

20. A seal array for use with a packer having a packer mandrel and first and second gauge rings for compressing and energizing the seal array to seal against the inside wall of a well casing and against the packer mandrel, the seal array comprising:

a resilient seal body;

at least a first and second end ring disposed proximate opposing ends of the seal body; and each of the rings including at least first and second discrete deformable portions, wherein the first deformable portion is adapted to move axially along the packer mandrel and the second deformable portion is adapted to move radially outwardly away from the packer mandrel, wherein each ring further comprises a hinge portion between the first and second deformable portions.

21. The seal array of 20, wherein the hinge portion is formed of a resilient, deformable material.

22. The seal array of claim 21, wherein the hinge portion is adapted to enable the second deformable portion to move radially outwardly without lifting the first deformable portion.

23. The seal array of claim 20, wherein each of the first and second discrete deformable portions comprises a wire mesh unit.

24. A packer assembly to seal against the inside wall of a well casing, comprising:

a packer mandrel;

a seal array disposed around the packer mandrel, the seal array comprising:

a resilient seal body;

at least a first and second end ring disposed proximate opposing ends of the seal body;

each of the rings including at least first and second discrete deformable portions; and first and second gauge rings disposed around the packer mandrel on opposing ends of the seal array for compressing and energizing the seal array to seal against the inside wall of a well casing and against the packer mandrel, wherein the first deformable portion is adapted to move axially along the packer mandrel and the second deformable portion is adapted to move radially outwardly away from the packer mandrel, wherein the first and second deformable portions are not interlocked to enable the second deformable portion to move radially outwardly without lifting the first deformable portion.

25. The packer assembly of claim 24, wherein the first deformable portion is positioned radially between the packer mandrel and the second deformable portion.

26. A packer assembly to seal against the inside wall of a well casing, comprising:

a packer mandrel;

a seal array disposed around the packer mandrel, the seal array comprising:

a resilient seal body;

at least a first and second end ring disposed proximate opposing ends of the seal body;

each of the rings including at least first and second discrete deformable portions; and first and second gauge rings disposed around the packer mandrel on opposing ends of the seal array for compressing and energizing the seal array to seal against the inside wall of a well casing and against the packer mandrel, wherein the first deformable portion is adapted to move axially along the packer mandrel and the second deformable portion is adapted to move radially outwardly away from the packer mandrel, wherein the first deformable portion is positioned radially between the packer mandrel and the second deformable portion, wherein each ring further comprises a resilient, deformable hinge portion disposed between the first and second deformable portions.

27. The packer assembly of claim 26, wherein the hinge portion is attached to the first and second deformable portions.

28. The packer assembly of claim 26, wherein the hinge portion is attached to the seal body.

29. The packer assembly of claim 26, wherein the hinge portion is integral with the seal body.

30. The packer assembly of claim 26, wherein each of the first and second deformable portions comprises wire mesh units.

31. A packer assembly to seal against the inside wall of a well casing, comprising:

a packer mandrel;

a seal array disposed around the packer mandrel, the seal array comprising:

a resilient seal body;

at least a first and second end ring disposed proximate opposing ends of the seal body;

each of the rings including at least first and second discrete deformable portions; and first and second gauge rings disposed around the packer mandrel on opposing ends of the seal array for compressing and energizing the seal array to seal against the inside wall of a well casing and against the packer mandrel, wherein each end ring further comprises a retaining ring abutting the seal body.

32. The packer assembly of claim 31, wherein the retaining ring is disposed between the seal body and the first deformable portion.

33. The packer assembly of claim 32, wherein the retaining ring has a diameter sized to have substantially the same diameter as the first deformable portion.

34. The packer assembly of claim 33, wherein a combination of the first deformable portion and the retaining ring provides a double back-up system to prevent extrusion.

35. A packer seal for sealing between a packer body and a wall of a well conduit, the packer seal comprising:

a seal element having opposing ends;

a first axial sealing portion and a second axial sealing portion for abutting the packer body and positioned proximal opposing sides of the seal element;

a first radial sealing portion and a second radial sealing portion abutting opposing sides of the seal element; and the first and second radial sealing portions positioned radially outside the first and second axial sealing portions respectively, wherein each of the first and second radial sealing portions is adapted to move radially outwardly without lifting a corresponding one of the first and second axial sealing portions.

36. A packer seal for sealing between a packer body and a wall of a well conduit, the packer seal comprising:

a seal element having opposing ends;

a first axial sealing portion and a second axial sealing portion for abutting the packer body and positioned proximal opposing sides of the seal element;

a first radial sealing portion and a second radial sealing portion abutting opposing sides of the seal element;

the first and second radial sealing portions positioned radially outside the first and second axial sealing portions respectively;

a first resilient, deformable hinge portion disposed between the first axial sealing portion and the first radial sealing portion; and a second resilient, deformable hinge portion disposed between the second axial sealing portion and the second radial sealing portion.

37. The packer seal of claim 36, wherein the first and second axial sealing portions abut the seal element.

* * * * *